US005211040A

United States Patent [19]

Gisiger

[11] Patent Number: 5,211,040

[45] Date of Patent: May 18, 1993

[54] COMBINATION LOCK

[75] Inventor: Urs Gisiger, Selzach, Switzerland

[73] Assignee: Amiet AG, Oberdorf, Switzerland

[21] Appl. No.: 884,018

[22] Filed: May 18, 1992

[30] Foreign Application Priority Data

May 21, 1991 [CH] Switzerland ..... 1494/91

[51] Int. Cl.[5] ..... E05B 37/12

[52] U.S. Cl. ..... 70/71; 70/312; 70/326; 70/328

[58] Field of Search ..... 70/3-5, 70/69, 71, 72, 74, 312, 315-318, 326-328, DIG. 33

[56] References Cited

U.S. PATENT DOCUMENTS

| | | | |
|---|---|---|---|
| D. 283,005 | 3/1986 | Gisiger | 70/312 X |
| 4,343,162 | 8/1982 | Giacometti | 70/71 X |
| 4,596,125 | 6/1986 | Castiglioni et al. | 70/312 |
| 4,926,663 | 5/1990 | Azzalin | 70/312 X |

FOREIGN PATENT DOCUMENTS

| | | | |
|---|---|---|---|
| 3929033 | 11/1990 | Fed. Rep. of Germany | 70/69 |

*Primary Examiner*—Lloyd A. Gall

*Attorney, Agent, or Firm*—Hovey, Williams, Timmons & Collins

[57] ABSTRACT

A combination lock includes a housing, amount upon which is mounted first and second slide members, and a spring plate. The first slide member carries a stop stud that engages a closing lug as the first member shifts under spring bias in a plane from an open to a closed position. The second slide member is coupled with the first member and shifts in a plane substantially parallel with that of the first member. Additionally, the second member contains recesses capable of accommodating a tumbler disc that enables shiftable motion of the second member only when a cam on the tumbler is aligned with grooves in the mount. The tumbler disc connects with toothed structure on a combination setting wheel, and the spring plate contains respective fingers for biasing the setting wheel against the tumbler and for engaging catch recesses on the setting wheel. The spring plate further contains a finger for biasing the locking lug for ejection from the housing.

6 Claims, 2 Drawing Sheets

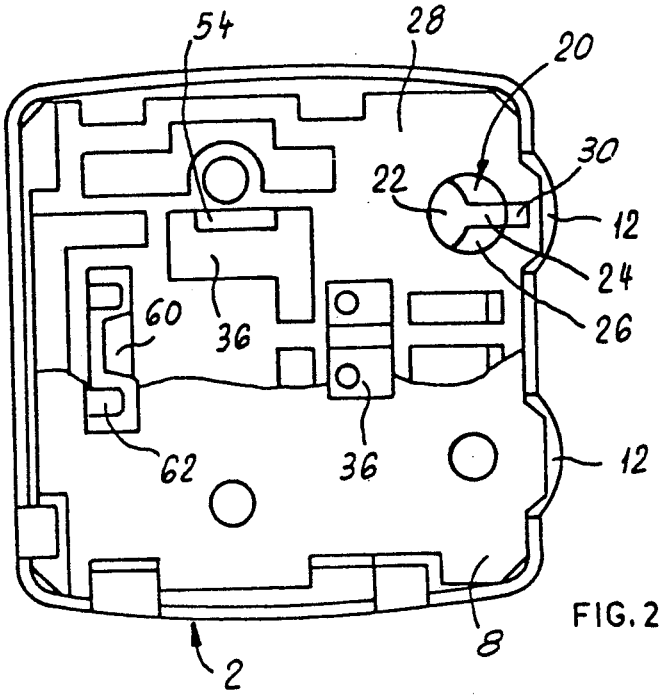
FIG. 2
FIG. 6a
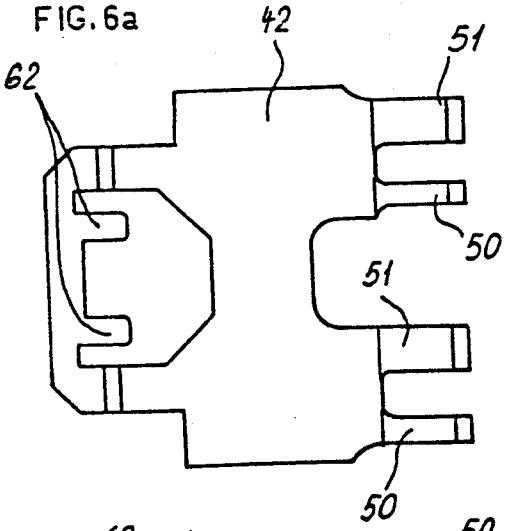
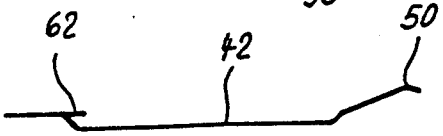
FIG. 6b
FIG. 4a
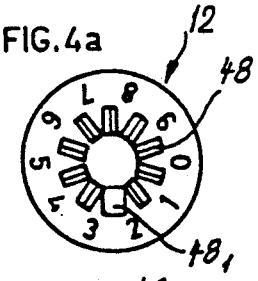
FIG. 5c
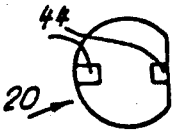
FIG. 4b
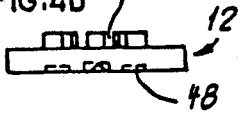
FIG. 5b
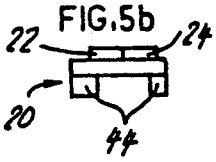
FIG. 4c
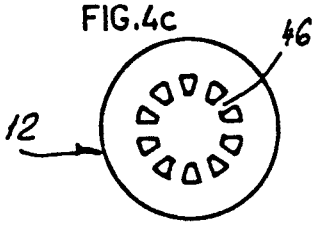
FIG. 5a
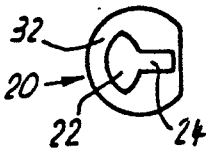

COMBINATION LOCK

FIELD OF THE INVENTION

The invention relates to a combination lock which may be used for bags and cases.

BACKGROUND ART

Several combination locks of the aforementioned type are known, for example from CH-PS 656 914 or from DE-OS 39 29 033.

A disadvantage with these known combination locks is that they are constructed in a relatively complicated manner, having, for example, a prestress spring for holding the setting disc and the tumbler disc together. Moreover, they have a separate catch spring which cooperates with catch recesses of the setting disc. Finally, another separate ejection spring is also present in order to push out the closing lug with the stop stud open.

SUMMARY OF THE INVENTION

According to the present invention there is provided a combination lock comprising a housing, a mount supporting a first slide member and a second slide member coupled thereto, the first slide member being capable of sliding in a plane from a first position to a second position and being biased towards the first position and having a stud capable of securing a closing lug, the second slide member capable of sliding in a plane parallel or substantially parallel to the first slide member and having one or more recesses each capable of accommodating a tumbler disc, the tumbler disc being capable of being moved by the second slide member only when a protrusion on a first face of the tumbler disc is aligned with a groove in the mount, the tumbler disc further comprising one or more than one tooth on a second face, each tooth being capable of cooperating with a respective hollow on a first face of a setting disc, wherein the combination lock further comprises a spring in the form of a plate formed of a resiliently flexible material having on one edge region one or more first finger tending to force the setting disc against the tumbler disc and one or more second finger each capable of protruding into one of a plurality of catch recesses on a second face of the setting disc, wherein the number of catch recesses corresponds to the number of secret codes on the setting disc, and wherein the opposite edge region of the plate has one or more third finger biased to act on the closing lug to tend to eject it.

Through the arrangement of the spring plate, which has a threefold function, in that in one respect it contains at least one spring finger, which is constructed to act as an ejection spring, as well as further spring fingers, each of which are constructed to act as a prestress spring or as a catch spring, there results a substantial simplification of the construction of the combination lock and therefore finally also a simplification of the operational method of the combination lock, since the plate avoids the need for three separate springs.

In a preferred feature, the setting disc cooperates with a tumbler disc by means of a jaw clutch.

An actuation button may also be provided for moving the second slide member when the protrusion on the first face of the tumbler disc is aligned with the groove in the mount.

Preferably, the one or more first finger and the one or more second finger act on substantially the same radial area of the setting disc, and wherein the one or more first finger is wider than the one or more second finger and is also wider than the catch recesses.

Preferably, a catch recess which is associated with a position corresponding to zero is longer and deeper than the other catch recesses.

In another preferred embodiment the plate is further constructed as a cover plate.

The catch spring finger and the prestress spring finger can act on different radial regions of the setting disc.

BRIEF DESCRIPTION OF THE DRAWINGS

FIG. 2 shows a bottom view of the combination lock, partially in section;

FIGS. 4*a*, 4*b*, 4*c* show a plan view, side view and bottom view of a setting disc of the combination lock;

FIGS. 5*a*, 5*b*, 5*c* show a bottom view, side view and plan view of the tumbler disc; and FIGS. 6*a*, 6*b* show an outline and side view of a spring plate.

DETAILED DESCRIPTION OF THE DRAWINGS

Figure 3:
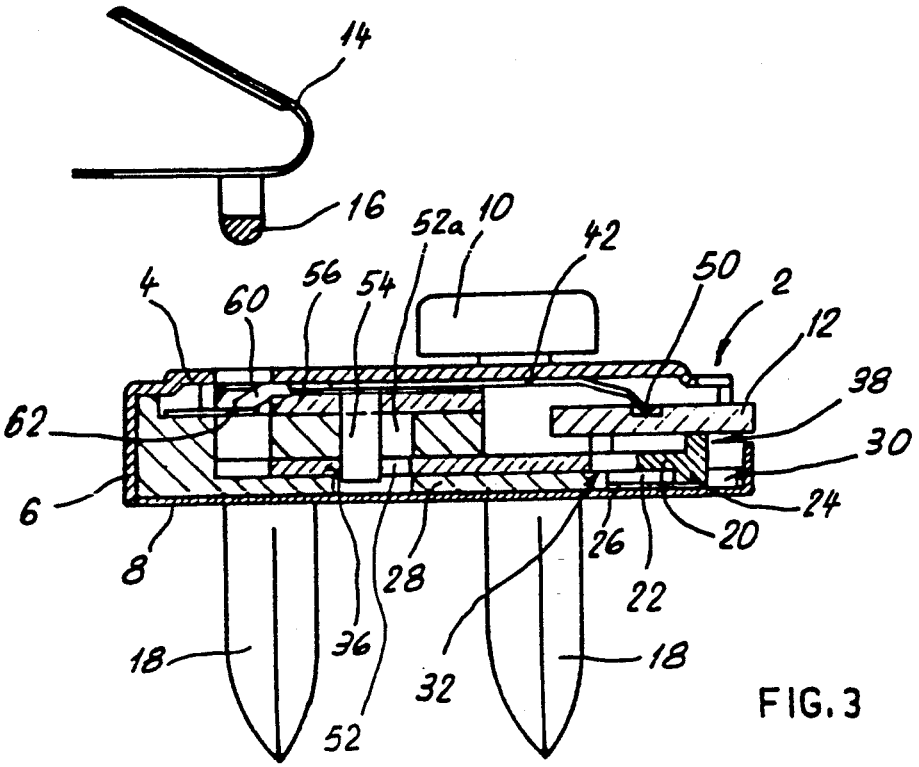
FIG. 3 shows the combination lock in section taken along III-III of FIG. 1.
Figure 1:
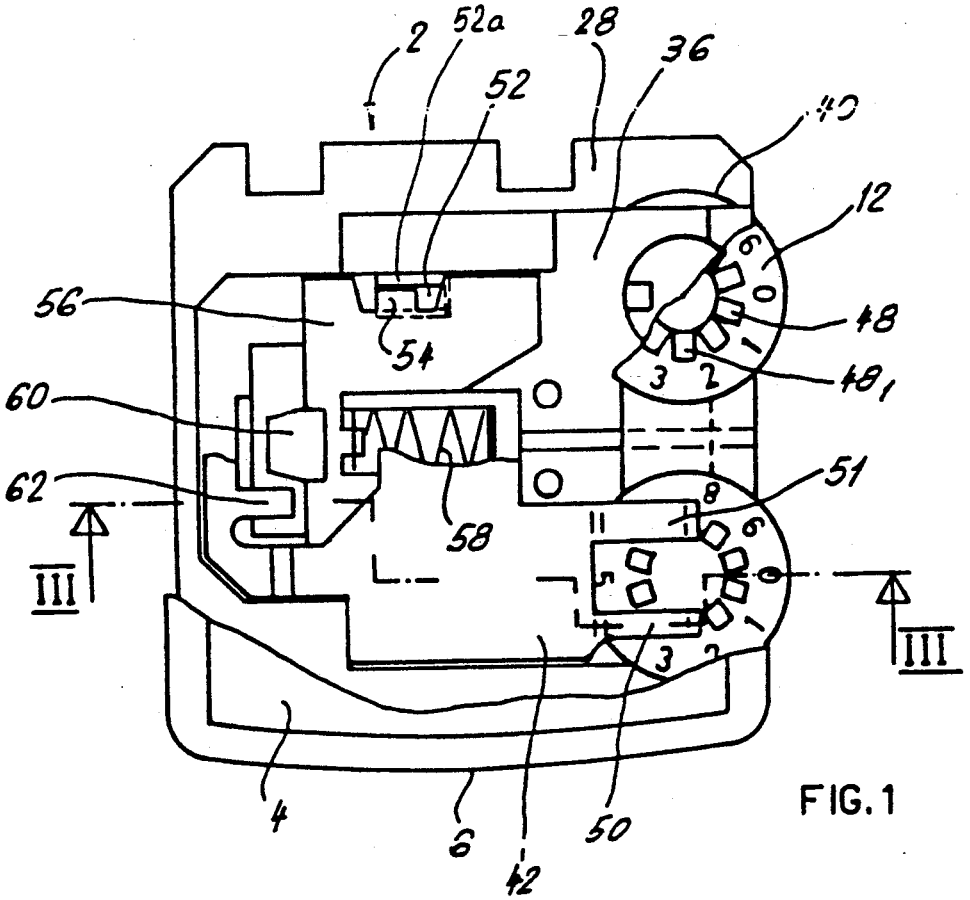
FIG. 1 shows a plan view of a combination lock, partially in section.

As can be inferred in particular from FIGS. 1 to 3, the combination lock contains a housing 2 with a front plate 4, side parts 6 and a base plate 8. An actuation button 10 is arranged on the front plate 4 and two setting discs 12 of two secret-code resetting devices are arranged on a side part. A hinge part 14, which can be fastened, for example, to the cover of a case, has a closing lug 16, with which it can be connected to the lock part of the combination lock. Furthermore, fastening lugs 18 are arranged on the housing 2, with which lugs the combination lock can be fastened to a container, for example a case.

Each secret-code resetting device of the combination lock has a tumbler disc 20, which is rotatably mounted by means of a guide element 22 and a stop cam 24 lying radially opposite thereto in a bore 26 in the mount 28 of the combination lock. The mount 28 comprises, for example, a plastic body. In the wall of the mount bore 26 is arranged a groove 30, into which the stop cam 24 with the correctly set secret code can be engaged through radial displacement of the tumbler disc 20. The tumbler disc 20 further comprises a collar 32, by which it is supported on one side on the edge of the mount bore 26. On the other side, the collar is encompassed by more than 180° by a recess 34 of the second slide member serving as an actuation slide 36. By means of this actuation slide 36 the tumbler disc 20 can be radially displaced with respect to the setting disc 12 in a manner which is represented in more detail in the following.

The tumbler disc 20 is connected by way of a jaw clutch 38 to the, setting disc 12, which is rotatably mounted in a recess 40 of the mount 28 and is held in the mount by means of a spring plate 42. The jaw clutch is formed by means of two opposing, radially aligned and axially projecting coupling teeth 44 on the tumbler disc 20. The coupling teeth 44 engage on the underside of the setting disc 12 into radially aligned recesses 46 of setting disc 12. The number of the recesses 46 corresponds to the number of the secret codes. A number of catch recesses 48 corresponding with the number of secret codes are arranged around a circle on the upper side of the setting disc 12. Catch recesses 48 form together with a catch spring finger 50 arranged on the spring plate 42 a catch device, in order to secure the setting disc 12 in each case in the desired position of the secret code. One of the catch recesses $48_1$ is formed so as to be longer and deeper than the other catch recesses and defines the zero position of the catch device, into which the catch spring finger 50 engages. From this zero position the setting disc 12 can only be set further in one direction, being blocked in the other direction. The spring plate 42 contains another prestress spring finger 51, which is wider than the catch spring shackle 50 and serves to secure the setting disc 12 and tumbler disc 20 both against one another and on the mount 28. The prestress spring finger 51 is wider than the catch spring finger 50 but also wider than the radial catch recesses 48 of the catch device, so that the prestress spring finger 51 cannot cooperate with the catch recesses 48 or $48_1$.

To the actuation slide 36 coupled to the tumbler disc 20 is fastened the actuation button 10, which serves to displace the actuation slide 36. On opposing sides the latter contains slots 52, into which carriers 54 engage, which are arranged on the first slide member serving as a stop slide 56. This stop slide is prestressed in the closing position by means of a spring 58. Carrier 54 extends from member 56 to within slots 52 across slot 52*a*. The carrier/slot coupling is constructed in such a way that with the actuation slide 36 located in the stop position, nevertheless the stop slide 56 enables an insertion of the closing lug 16. In this respect, the stop stud 60 of the stop slide 56 can be pushed back against the force of the spring 58 corresponding with the play of the carrier/-slot coupling. With the stop stud 60 is associated an ejection spring 62, which are likewise formed by spring fingers of the spring plate 42. As can be inferred from FIG. 3, the ejection spring 62 is pressed downwards upon insertion of closing lug 16 and is thereby tensioned. The inserted lug 16 is held in the engaged state by the stud 60. In addition to this, the spring plate 42 also serves to secure the locking mechanism in the mount 28 or housing 2 of the combination lock.

To open the combination lock the setting discs 12 must be set corresponding to the chosen secret code. In this position the stop cams 24 of the tumbler discs 20 are each opposite the grooves 30 in the mount 28, so that the actuation slide 36 can be displaced by means of the actuation button 10 in such a way that the stop cams 24 engage into the grooves 30. In this way the stop slide 56 is carried at the same time by way of the carrier/slot coupling and the stop stud 60 releases the closing lug 16 of the hinge part and is pushed out by means of the ejection spring finger 62. In this opened position a resetting of the secret code is also possible, since, on the one hand the tumbler disc 20 is blocked by the engagement of the stop cams 24 in the groove 30 and, on the other hand, the coupling teeth 44 are moved radially out of the recesses 46 of the jaw clutch 38, with the result that the setting disc 12 can be adjusted independently of the tumbler disc 20. In this way a new secret code can be set, which is then valid after the release of the actuation button 10 on the combination lock, since the coupling teeth 44 are engaged again into the recesses 46 of the jaw clutch 38.

The spring plate 42 with the catch spring finger 50 for each secret-code setting device as well as the likewise moulded prestress spring fingers 51 and the ejection spring fingers 62 create a substantial simplification of the components and of the construction of the combination lock, whereby not only can manufacture be made substantially cheaper, but in particular the operational safety and operability of the combination lock are also improved.

What is claimed is:

1. A combination lock comprising a housing, a mount supporting a first slide member and a second slide member coupled thereto, the first slide member being capable of sliding in a plane from a first position to a second position and being biased towards the first position and having a stud capable of securing a closing lug, the second slide member capable of sliding in a plane parallel or substantially parallel to the first slide member and having one or more recesses each capable of accommodating a tumbler disc, the tumbler disc being capable of being moved by the second slide member only when a protrusion on a first face of the tumbler disc is aligned with a groove in the mount, the tumbler disc further comprising one or more than one tooth on a second face, each tooth being capable of cooperating with a respective hollow on a first face of a setting disc, wherein the combination lock further comprises a spring in the form of a plate formed of a resiliently flexible material having on one edge region one or more first finger tending to force the setting disc against the tumbler disc and one or more second finger each capable of protruding into one of a plurality of catch recesses on a second face of the setting disc, wherein the number of catch recesses corresponds to the number of secret codes on the setting disc, and wherein the opposite edge region of the plate has one or more third finger biased to act on the closing lug to tend to eject it.

2. A combination lock according to claim, 1, wherein the setting disc cooperates with the tumbler disc by means of a jaw clutch.

3. A combination lock according to claim 1, further comprising an actuation button for moving the second slide member when the protrusion on the first face of the tumbler disc is aligned with the groove in the mount.

4. A combination lock according to claim 1, wherein the one or more first finger and the one or more second finger act on substantially the same radial area of the setting disc, and wherein the one or more first finger is wider than the one or more second finger and is also wider than the catch recesses.

5. A combination lock according to claim 1, wherein a catch recess which is associated with a position corresponding to zero is longer and deeper than the other catch recesses.

6. A combination lock according to claim 1, wherein the plate is further constructed as a cover plate.

* * * * *